US008547290B2

(12) United States Patent
Schertz et al.

(10) Patent No.: US 8,547,290 B2
(45) Date of Patent: Oct. 1, 2013

(54) DEVICE FOR CONVEYING SIGNALS FOR MOBILE ANTENNA POSITIONER

(75) Inventors: Thierry Schertz, Courbevoie (FR); Eric Vignolle, Breligny-sur-Orge (FR)

(73) Assignee: Thales, Neuilly sur Seine (FR)

( * ) Notice: Subject to any disclaimer, the term of this patent is extended or adjusted under 35 U.S.C. 154(b) by 309 days.

(21) Appl. No.: 12/809,995

(22) PCT Filed: Dec. 16, 2008

(86) PCT No.: PCT/EP2008/067650

§ 371 (c)(1),
(2), (4) Date: Dec. 20, 2010

(87) PCT Pub. No.: WO2009/083440

PCT Pub. Date: Jul. 9, 2009

(65) Prior Publication Data

US 2011/0095959 A1 Apr. 28, 2011

(30) Foreign Application Priority Data

Dec. 21, 2007 (FR) ..... 07 09053

(51) Int. Cl.
*H01Q 1/22* (2006.01)

(52) U.S. Cl.
USPC ..... 343/884; 343/905; 343/756

(58) Field of Classification Search
None
See application file for complete search history.

(56) References Cited

U.S. PATENT DOCUMENTS

| | | | | |
|---|---|---|---|---|
| 3,623,115 | A | 11/1971 | Schuttloffel et al. | |
| 4,876,553 | A | 10/1989 | Nathrath et al. | |
| 5,245,301 | A * | 9/1993 | Portrait et al. | 333/256 |
| 5,543,808 | A * | 8/1996 | Feigenbaum et al. | 343/727 |
| 6,577,282 | B1 * | 6/2003 | Rao et al. | 343/781 CA |
| 6,995,638 | B1 * | 2/2006 | Smith et al. | 333/256 |
| 7,079,739 | B1 * | 7/2006 | Vitruk et al. | 385/123 |
| 2005/0062639 | A1 | 3/2005 | Biggs | |
| 2006/0017637 | A1 * | 1/2006 | Howell et al. | 343/754 |
| 2010/0188304 | A1 * | 7/2010 | Clymer et al. | 343/753 |

FOREIGN PATENT DOCUMENTS

| | | |
|---|---|---|
| FR | 1245442 | 11/1960 |
| FR | 2769969 A1 | 4/1999 |

* cited by examiner

*Primary Examiner* — Trinh Dinh
(74) *Attorney, Agent, or Firm* — Baker & Hostetler LLP

(57) ABSTRACT

A device for conveying signals for a mobile antenna positioner is provided. The device comprises a waveguide with a conductive structure including a first end connected to the antenna, and a second end connected to the mount of the positioner, wherein the waveguide has a continuous structure, each of its ends being attached by means allowing a range of movement of the waveguide in order to limit the bending forces of said guide and to reduce the force applied to the attachment means during the movements of the positioner. The device applies notably to communication systems with mobile antennas, and more particularly to the production of antenna stations comprising antenna positioners with a wide range of movement in relative bearing.

8 Claims, 5 Drawing Sheets

DEVICE FOR CONVEYING SIGNALS FOR MOBILE ANTENNA POSITIONER

CROSS-REFERENCE TO RELATED APPLICATIONS

This application is a National Stage of International Patent Application No. PCT/EP2008/067650, filed on Dec. 16, 2008, which claims priority to foreign Patent Application No. FR 07 09053, filed on Dec. 21, 2007, the disclosures of which are incorporated herein by reference in their entirety.

FIELD OF THE INVENTION

The present invention relates to a device for conveying signals for a mobile antenna positioner. The invention applies notably to communication systems with mobile antennas, and more particularly to the production of antenna stations comprising antenna positioners with a wide range of movement in relative bearing.

BACKGROUND OF THE INVENTION

As an example, antenna systems used in two-way communications between two mobile carriers are usually provided with a pursuit function, the antenna of each of said carriers then having to cover a wide pointing surface area, so that the radio-electric axes of each antenna remain oriented facing one another, irrespective of the movements of the carriers. In order to orient the antenna in the desired directions, an antenna system comprises a positioner, that is to say a programmable controller comprising a mobile portion to which the antenna is attached.

A first category of positioners, called tower positioners, makes it possible to orient the antenna by making it pivot, on the one hand, about a vertical axis in order to modify the angle of relative bearing and, on the other hand, about a horizontal axis in order to modify the angle of elevation. The signals transmitted and/or received by the mobile antenna are transmitted to a fixed portion, for example to the mount of the positioner, via a waveguide. When the antenna system has a large range of movement in relative bearing, or even has infinite relative bearing—in other words, when it allows the antenna to pivot indefinitely about the vertical axis—, the use of rotating collectors and/or of rotating joints at the junction of the waveguide with the fixed portion is necessary in order to prevent subjecting the waveguide to torsional forces which would damage it. A drawback of such antenna systems is their high cost of production.

A second category of positioners, made on the principle of a Cardan suspension, makes it possible to dispense with collectors and rotating joints. Certain of these positioners benefit from an enhancement proposed in a patent application published under reference FR2769969 for the applicant "ACC ingénierie & maintenance SA". These enhanced positioners comprise a pointing device with no top dead center based on a pantograph mechanism; they will be qualified in what follows as "pantograph positioners". In order to convey the electromagnetic signals between the antenna and the fixed mount of a pantograph positioner, waveguides that are sufficiently flexible and accept the torsional movements are used.

These waveguides consist of a discontinuous structure, often on the basis of interlocked scales which lead to reliability problems. Specifically, the structure of such a waveguide wears very quickly, and even breaks under the effect of the repeated torsional movements that are applied to it. Thus, the service life of the waveguide is short, which imposes regular preventive replacements. Moreover, considerable insertion losses and intermodulation products appear when this type of waveguide is used. In transmission, the powers are then severely limited.

SUMMARY OF THE INVENTION

It is an object of the invention to propose means making it possible to convey signals between the antenna and the mount of a positioner with a wide range of movement in relative bearing while limiting the insertion losses, the deterioration of the received signals and the problems of mechanical reliability. Accordingly, the subject of the invention is a device for conveying signals for a mobile antenna positioner with a wide range of movement in relative bearing comprising a waveguide with a conductive structure, a first end of which is connected to the antenna, a second end being connected to the mount of the positioner, said device being characterized in that the waveguide has a continuous structure, each of its ends being attached by means allowing a range of movement of the waveguide in order to limit the bending forces of said guide during the movements of the positioner.

According to one embodiment, the antenna positioner is an antenna positioner of the pantograph type.

According to one embodiment, the means for attaching the waveguide comprise at least one support, immobilization means and one or more swivel joint assemblies attached to said support, the end of the waveguide being kept substantially immobile relative to the support by the immobilization means, the waveguide being inserted in said swivel joint assemblies in order to stabilize the waveguide while conferring a range of movement thereon.

According to one embodiment, the device comprises at least one spring, the spring being held against the waveguide by cable ties.

According to one embodiment, the signals conveyed by the waveguide are microwave signals.

According to one embodiment, the waveguide is electroformed and made of an alloy comprising beryllium and copper, this material being well suited to the transmissions of microwave signals, and also being suitable for sustaining bends along its structure.

According to one embodiment, the waveguide has a bellows structure, the waveguide being able to be deformed alternately on a first axis of rotation and a second axis of rotation, the waveguide not being able to deform under the effect of a torsional movement.

Preferably, the inner wall of the waveguide is smooth and comprises no roughness or aperture.

BRIEF DESCRIPTION OF THE DRAWINGS

Other features will appear on reading the following detailed description given as an example and being non-limiting and made with respect to the appended drawings which represent.

DETAILED DESCRIPTION

For the purposes of clarity, the same reference numbers in different figures designate the same elements.

Figure 1A:
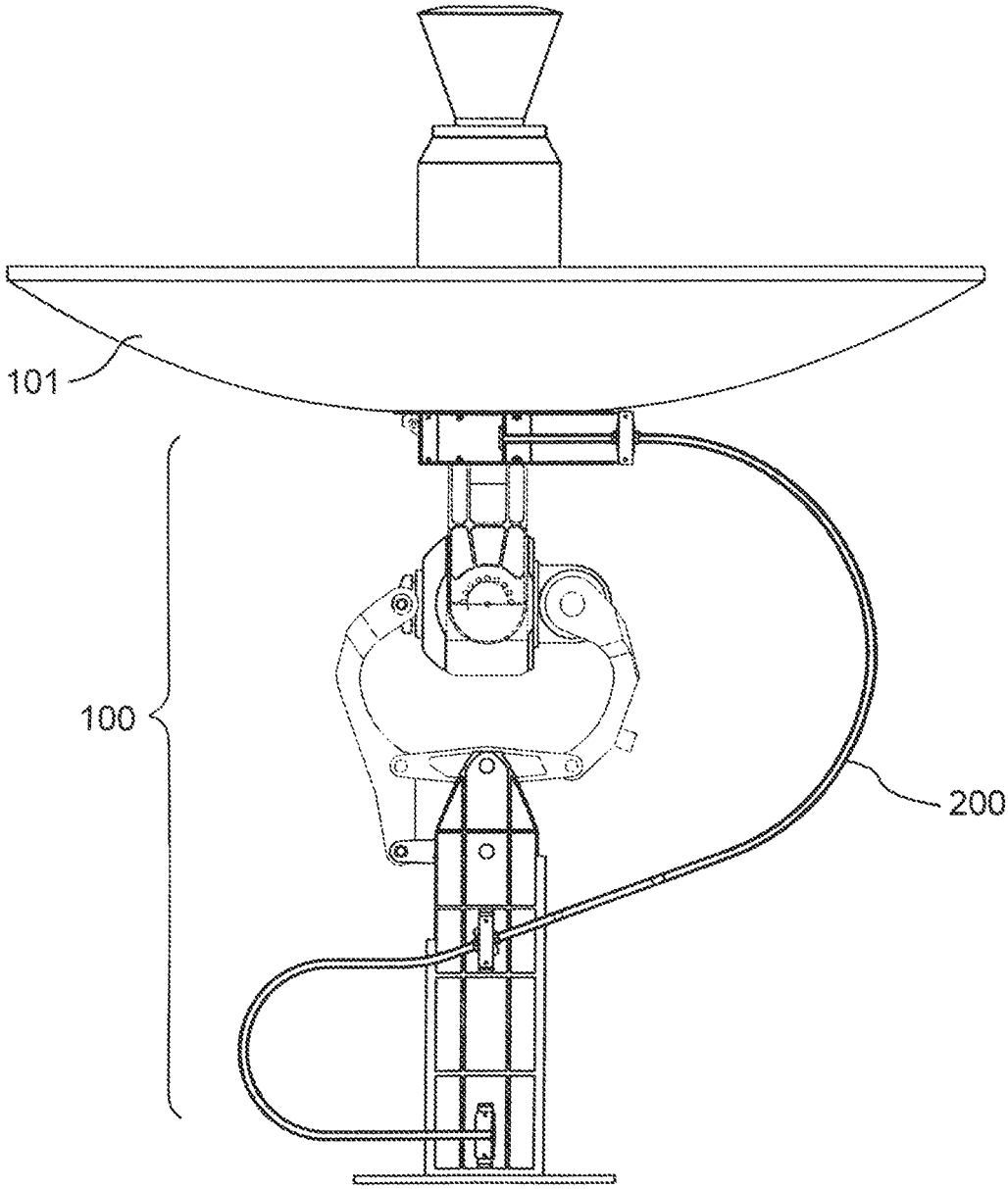
FIGS. 1A and 1B, diagrams illustrating various positions taken by a pantograph positioner, FIG. 2, an overview of an embodiment of the device for conveying signals according to the invention, attached to a pantograph positioner, FIG. 3, a detail of the means for attaching the signal-conveying device to the top portion of the positioner, FIG. 4, a detail of the means for attaching the signal-conveying device to the bottom portion of the positioner, FIG. 5, another embodiment of the means for attaching the signal-conveying device to the bottom portion of the positioner, FIG. 6, an illustration of the structure of the waveguide used in the conveying device according to the invention.
Figure 1B:
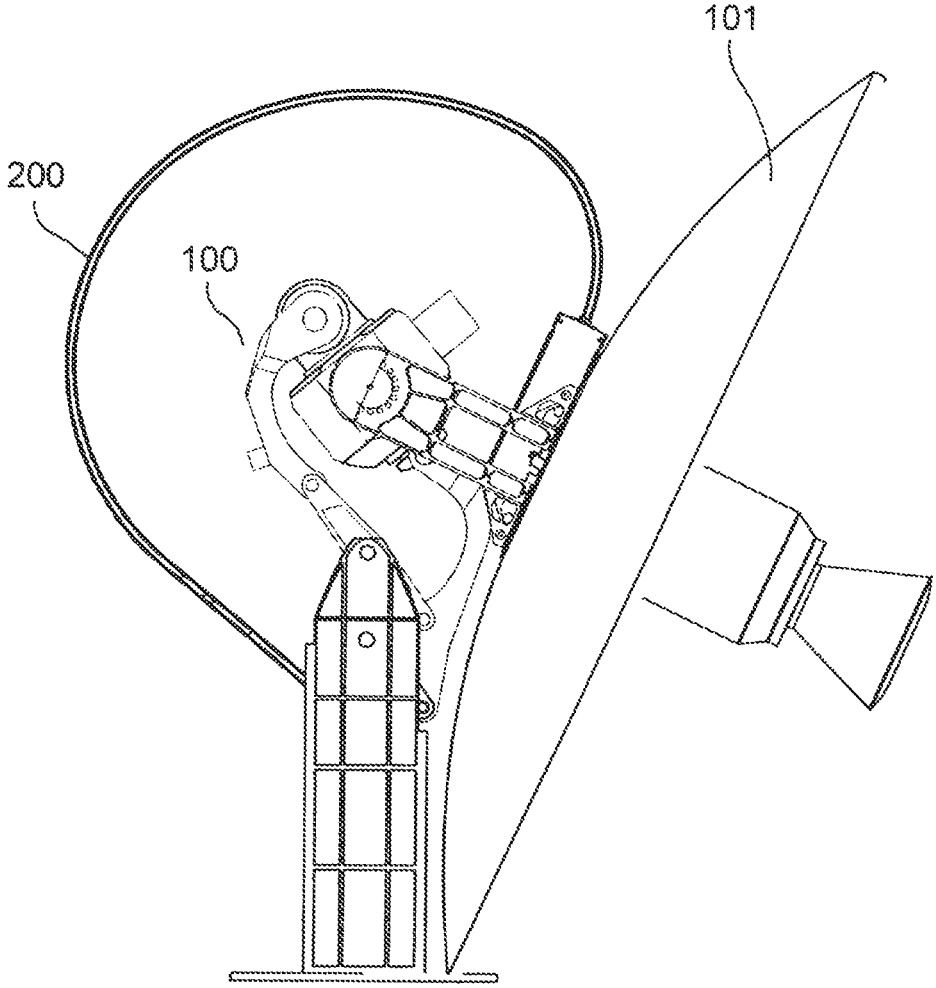

FIGS. 1A and 1B illustrate a pantograph positioner 100 in various positions.

FIG. 1A shows the pantograph positioner 100 orienting an antenna 101 vertically upward, and FIG. 1B shows the positioner 100 articulated so that the antenna 101 is oriented at a negative angle of elevation. A conveying device explained in detail hereafter comprises a waveguide 200 which connects the antenna 101 to the positioner 100.

Figure 2:
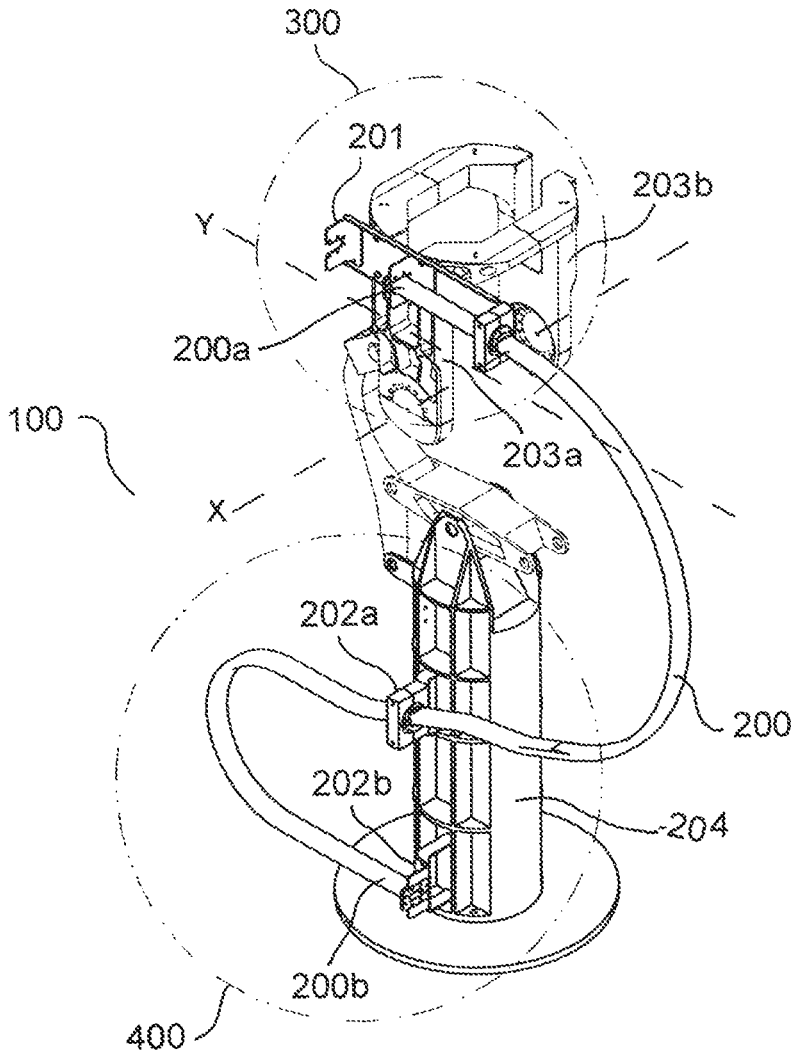

FIG. 2 shows an overview of an embodiment of the signal-conveying device according to the invention attached to the pantograph positioner 100. The signal-conveying device comprises the waveguide 200 attached, on the one hand, to a mobile portion 300 of the positioner 100 supporting the antenna 101 (FIG. 1), and, on the other hand, to a bottom and fixed portion 400 of the positioner. The first means 201 for attaching the waveguide 200 to said mobile portion 300 of the positioner 100 and the second means 202*a*, 202*b* for attachment to its bottom portion 400 are shown in detail respectively in FIGS. 3 and 4.

The mobile portion 300 of the positioner 100 moves about two axes of rotation X and Y, represented in dashed lines in FIG. 2. The top end 200*a* of the waveguide 200, which is attached to the mobile portion 300 of the positioner 100 by virtue of the first attachment means 201, is held substantially parallel with the second axis of rotation Y of the positioner, this second axis of rotation Y itself being subjected to a rotary movement about the first axis of rotation X. The bottom end 200*b* of the waveguide 200 is held in a fixed position by virtue of the second attachment means 202*a*, 202*b*, said bottom end being held, in the example, substantially horizontal. Moreover, in the example, the second attachment means 202*a*, 202*b* comprise a first attachment point 202*a* allowing a freedom of movement to the waveguide 200, and a second attachment point 202*b*, placed beneath the first 202*a*, making it possible to immobilize the bottom end 200*b* of the waveguide 200. Therefore, in the example, the waveguide 200 is held by three attachment points 201, 202*a*, 202*b*; it forms substantially an S between its top end 200*a* and its bottom end 200*b*, this S being deformed as a function of the movements of the mobile portion 300 of the positioner 100, alternately in a movement about the first axis of rotation X and about the second axis of rotation Y. In the example, the top end 200*a* of the waveguide 200 is attached to the fork 203*a* of the positioner, while the bottom end 200*b* of the waveguide 200 is attached to the height extension 204 of the positioner 100.

According to one embodiment, one or more springs (not shown in the figures) are attached to the waveguide 200 in order to prevent said guide 200 from collapsing on itself because of its own weight, and therefore to better distribute the mechanical stresses applied to the waveguide 200. These springs may be distributed sporadically over the waveguide 200 or may extend over its whole length, the stiffness of a spring notably being chosen as a function of the weight of the waveguide 200, of the dimension of the waveguide, and of the dimension of the positioner 100. The springs are attached so as to be able to slide only along a plane of the guide through flexible fasteners, such as, for example, plastic cable ties.

The continuous character of the structure of the waveguide 200—which makes it possible to obtain good performance in terms of signal transmission—makes it necessary to design specific attachment means in order to limit the mechanical forces that are applied to it when the positioner 100 moves.

Figure 3:
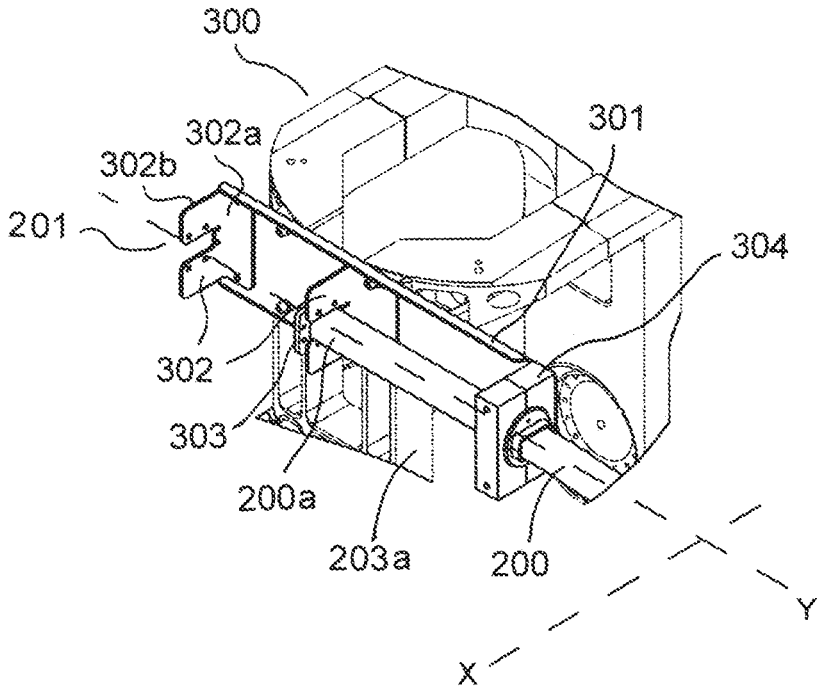

FIG. 3 shows, for the embodiment of FIG. 2, a detail of the means 201 for attaching the signal-conveying device to the top and mobile portion 300 of the positioner. These attachment means 201 comprise a support 301 attached to the top and mobile portion 300 of the positioner which, in the example, is the fork 203*a*. In the example, the support 301 is a rectangular rigid plate one wall of which is attached to the fork 203*a* of the positioner 100, the support 301 thus forming a plane orthogonal to the first axis of rotation X. One or more brackets 302 are attached to the opposite wall of the support 301, the two orthogonal planes 302*a*, 302*b* formed by the walls of each bracket 302 themselves being orthogonal to the plane formed by the two axes of rotation X and Y. The first wall 302*a* of each bracket 302 is joined to the support 301, while the second wall 302*b* of the bracket 302 is orthogonal to the second axis of rotation Y. A flange 303 secured to the waveguide 200 is placed on the second wall of each bracket 302 so that the waveguide 200 is clamped by each of the flanges 303 along the support 301 and its top end 200*a* is held fixed relative to the mobile portion 300 of the positioner 100 in order to be connected to the antenna 101 (FIGS. 1A and 1B).

Since the top end 200*a* of the waveguide 200 is held fixed relative to the mobile portion 300 of the positioner 100 while the bottom portion 200*b* (FIG. 4) of the waveguide 200 remains fixed, the waveguide 200 must support bending forces because of the movements of the positioner 100, both about the first axis of rotation X and about the second axis of rotation Y. In order to limit these bending forces, the waveguide 200 is inserted into one or more swivel joint assemblies 304 placed in the extension of the brackets 302, along the support 301. In this manner, the waveguide 200 is held in place while having a range of movement that allows it to better withstand the flexing imposed by the movement of the positioner 100 and simultaneously to reduce the stresses applied to the flange 303. The spacings between the swivel joint assemblies 304 can be adapted as a function notably of the length of the waveguide 200 and of its flexibility characteristics.

Figure 4:
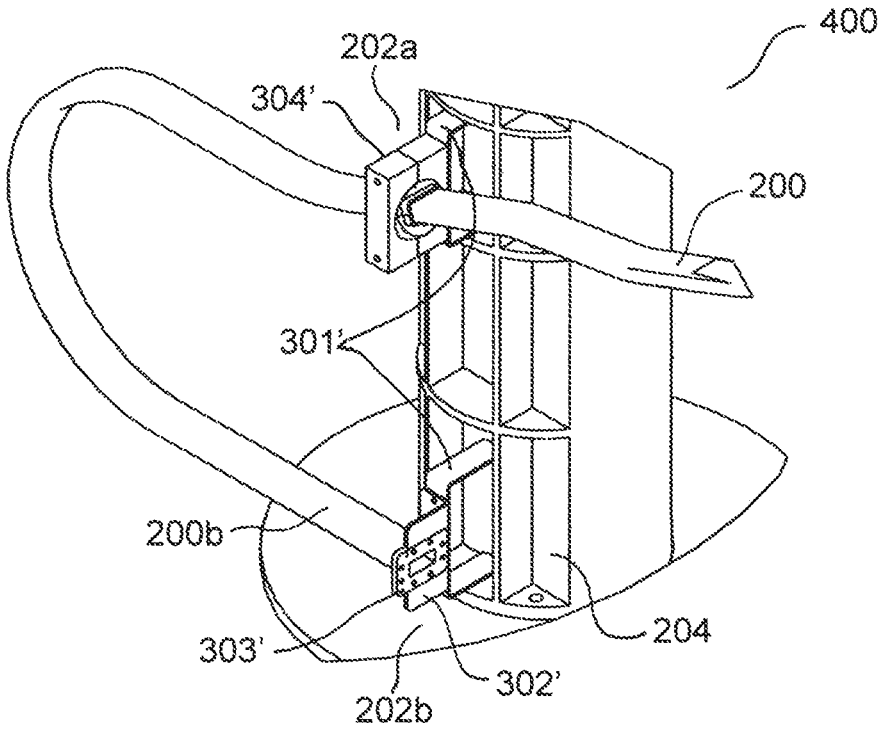

FIG. 4 shows, for the embodiment of FIG. 2, a detail of the means 202*a*, 202*b* for attaching the signal-conveying device to the bottom portion 400 of the positioner 100. In the example of FIG. 4, the attachment means 202*a*, 202*b* comprise a first portion 202*a* situated substantially above a second portion 202*b*.

The first portion 202*a* of the attachment means 202*a*, 202*b* comprises a swivel-joint assembly 304' attached to a support 301' and the second portion 202*b* comprises an attachment flange 303' attached to a bracket 302' which is attached to a support 301". The waveguide 200 is held by the swivel joint assembly 304' of the first portion 202*a* and the bottom end 200*b* of the waveguide 200 is attached to the second portion 202*b* via the attachment flange 303' so that the waveguide 200 creates substantially a half-loop between the first portion 202*a* and the second portion 202*b*.

Figure 5:
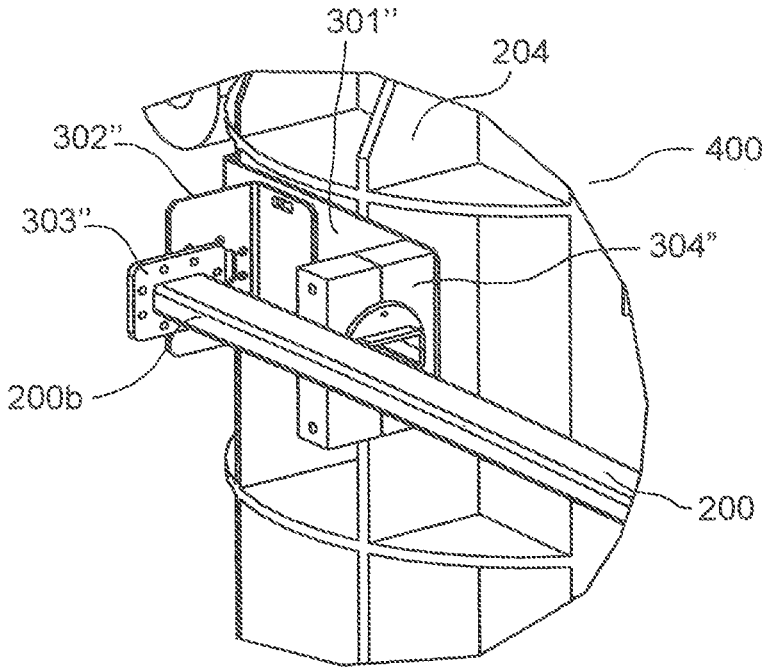

According to another embodiment shown in FIG. 5, the means 202 for attaching the signal-conveying device to the bottom portion 400 of the positioner 100 are similar to those shown in FIG. 3. They also comprise one or more brackets 302" substantially in line with a support 301". In FIG. 5, the waveguide 200 is shown slightly set back from the bracket 302". The bottom end 200*b* of the waveguide 200 is attached to the bracket 302" by means of an attachment flange 303". Preferably, the waveguide 200 is also stabilized with one or more swivel joint assemblies 304" in order to give it a range of movement in order to limit the bending forces that are applied to it, as in FIG. 3 and to reduce the force applied to the attachment flange 303".

Figure 6:
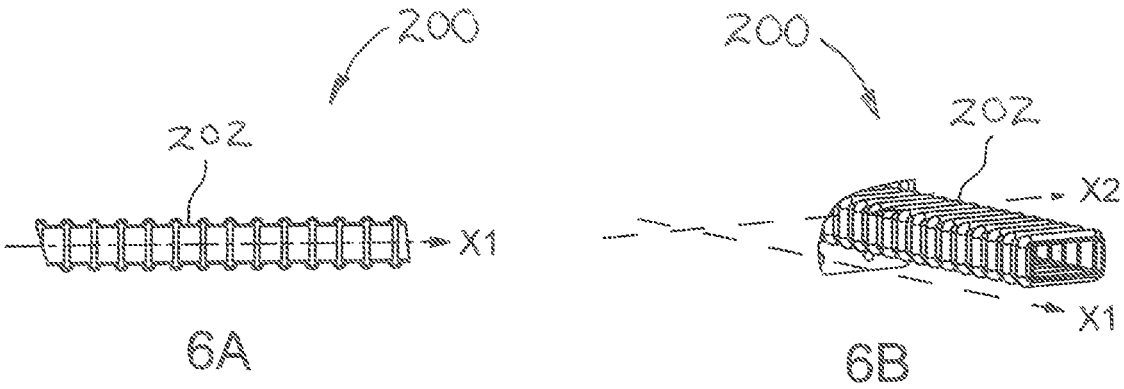

FIG. 6 illustrates the structure of the waveguide 200 with a cross section 6A and a view in perspective 6B. The waveguide 200 has a continuous structure, that is to say that, unlike a conventional structure formed by several linked elements, the waveguide 200 used in the signal-conveying device according to the invention is formed in a single piece, with no opening or roughness on its inner wall. In the example, the waveguide 200 comprises a bellows structure 202, of rectangular section, with a conductive inner wall, in this instance made of an alloy comprising beryllium and copper. Advantageously, the waveguide is electroformed.

Unlike a waveguide with a discontinuous structure, the waveguide 200 used in the present invention cannot, because of its continuous character, sustain a torsional movement at one and the same point, that is to say sustain two orthogonal bends at one and the same point. Therefore, the waveguide 200, in order nevertheless to adapt to the mechanical stresses imposed by the movement of the positioner 100, is suitable for sustaining flexions in different directions in several successive locations, notably by virtue of the material used and its bellows structure 202.

Unlike a waveguide with a discontinuous structure, the waveguide 200 used in the present invention cannot, because of its continuous character, sustain a torsional movement at one and the same point, that is to say sustain two orthogonal bends at one and the same point. Therefore, the waveguide 200, in order nevertheless to adapt to the mechanical stresses imposed by the movement of the positioner 100, is suitable for sustaining flexions in different directions in several successive locations, notably by virtue of the material used and its bellows structure.

Preferably, the length of the waveguide 200 should be chosen so as to minimize the flexing forces that are applied to it; therefore a waveguide 200 that is too short for example would risk causing mechanical breakages.

The use of a signal-conveying device according to the invention makes it possible to reduce the insertion losses, to insulate the waveguide over time and not to generate intermodulation products toward the outside of the waveguide particularly for high-power microwave signals. Moreover, by virtue of the attachment means employed, and despite the continuous character of the structure of the waveguide, the latter is not subjected to bending forces that are too great, thus ensuring good reliability of the device. The signal-conveying device according to the invention is particularly suited to pantograph antenna positioners and makes it possible to provide infinite rotational coverage of the range-of-movement zone of the positioner. Nevertheless, it can also be mounted on positioners of different types and notably positioners of the tower type with a wide range of movement in relative bearing.

What is claimed is:

1. A device for conveying microwave signals for a positioner of a mobile antenna with a wide range of movement in relative bearing, said device comprising:

a fixed portion;

a mobile portion operatively coupled to the fixed portion, the mobile portion being operative to independently rotate the antenna about an X-axis and a Y-axis relative to the fixed portion, the Y-axis being subject to rotary movement of the X-axis, the X-axis being distinct from the Y-axis; and a waveguide with a conductive structure, a first end of which is connected to the antenna, a second end being connected to a mount of a positioner for the antenna, wherein the waveguide has a continuous structure including at least one swivel-joint coupling the waveguide to the fixed portion, the waveguide including substantially an S-shape to accommodate a wide range of movement, and wherein each of the first end and the second end of the waveguide is attached to either the antenna or the positioner by means for attaching the waveguide that allows a range of movement of the waveguide in order to limit bending forces of said waveguide during movements of the positioner.

2. The device as claimed in claim 1, wherein the antenna positioner includes a pantograph mechanism.

3. The device as claimed in claim 1, wherein the means for attaching the waveguide includes at least one support attached to the at least one swivel joint, and immobilization means, wherein either the first end or the second end of the waveguide is held substantially immobile relative to the support by the immobilization means, and wherein the waveguide is inserted in said at least one swivel-joint in order to stabilize the waveguide while conferring a range of movement thereon.

4. The device as claimed in claim 1, wherein the signals conveyed by the waveguide are microwave signals.

5. The device as claimed in claim 1, wherein the waveguide is made of an alloy comprising beryllium and copper using an electroforming process.

6. The device as claimed in claim 1, wherein the waveguide has a bellows structure.

7. The device as claimed in claim 1, wherein an inner wall of the waveguide is smooth and includes no roughness or aperture.

8. The device as claimed in claim 1, wherein the antenna has infinite rotational coverage of a rage-of-movement zone of the positioner about the X-axis.

* * * * *